US008315871B2

(12) United States Patent
Wang et al.

(10) Patent No.: US 8,315,871 B2
(45) Date of Patent: Nov. 20, 2012

(54) HIDDEN MARKOV MODEL BASED TEXT TO SPEECH SYSTEMS EMPLOYING ROPE-JUMPING ALGORITHM

(75) Inventors: Wenlin Wang, Beijing (CN); Guoliang Zhang, Beijing (CN); Jingyang Xu, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 695 days.

(21) Appl. No.: 12/478,342

(22) Filed: Jun. 4, 2009

(65) Prior Publication Data

US 2010/0312562 A1 Dec. 9, 2010

(51) Int. Cl.
*G10L 13/00* (2006.01)

(52) U.S. Cl. ..... 704/258; 704/260; 704/264; 704/266; 704/269

(58) Field of Classification Search ..... 704/258, 704/260, 266
See application file for complete search history.

(56) References Cited

U.S. PATENT DOCUMENTS

| | | | | |
|---|---|---|---|---|
| 6,151,575 | A * | 11/2000 | Newman et al. | 704/260 |
| 6,202,049 | B1 * | 3/2001 | Kibre et al. | 704/267 |
| 7,257,532 | B2 | 8/2007 | Toyama | |
| 2003/0097266 | A1 * | 5/2003 | Acero | 704/260 |
| 2004/0181409 | A1 | 9/2004 | Gong et al. | |
| 2007/0005355 | A1 | 1/2007 | Tian et al. | |
| 2007/0276666 | A1 * | 11/2007 | Rosec et al. | 704/260 |
| 2008/0059190 | A1 | 3/2008 | Chu et al. | |
| 2008/0201150 | A1 * | 8/2008 | Tamura et al. | 704/266 |
| 2009/0048841 | A1 * | 2/2009 | Pollet et al. | 704/260 |
| 2009/0055162 | A1 | 2/2009 | Qian et al. | |

OTHER PUBLICATIONS

M. Plumpe, A. Acero, H. Hon and X. Huang, "HMM-based Smoothing for Concatenative Speech Synthesis," Proc. of ICSLP, vol. 6, pp. 2751-2754, 1998.*

Zen, H., Toda, T. and Tokuda, K., "The Nitech-NAIST HMM-based speech synthesis system for the Blizzard Challenge 2006", IEICE Trans. on Information and Systems, 2006.*

Yamagishi, J.; Kobayashi, T.; Nakano, Y.; Ogata, K.; Isogai, J.; , "Analysis of Speaker Adaptation Algorithms for HMM-Based Speech Synthesis and a Constrained SMAPLR Adaptation Algorithm," Audio, Speech, and Language Processing, IEEE Transactions on , vol. 17, No. 1, pp. 66-83, Jan. 2009.*

Li, et al., "HMM Adaptation using a Phase-Sensitive Acoustic Distortion Model for Environment-Robust Speech Recognition", Retrieved at <<http://research.microsoft.com/pubs/78297/2008-jinyu-icassp2.pdf>>, IEEE International Conference on Acoustics, Speech, and Signal Processing, Mar. 30-Apr. 4, 2008, pp. 4069-4072.

Paliwal, K. K., "On the Use of Line Spectral Frequency Parameters for Speech Recognition", Retrieved at <<http://maxwell.me.gu.edu.au/spl/publications/papers/dsp92_kkp_lsf.pdf>>, Digital Signal Processing, vol. 2, 1992, pp. 80-87.

Zhenjun, et al., "Voice Conversion using HMM Combined with GMM", Retrieved at <<http://ieeexplore.ieee.org/stamp/stamp.jsp?arnumber=4566851&isnumber=4566766>>, Congress on Image and Signal Processing, vol. 5, No. 27-30, May 2008, pp. 366-370.

(Continued)

*Primary Examiner* — Paras D Shah
(74) *Attorney, Agent, or Firm* — Turk IP Law, LLC

(57) ABSTRACT

A rope-jumping algorithm is employed in a Hidden Markov Model based text to speech system to determine start and end models and to modify the start and end models by setting small co-variances. Disordered acoustic parameters due to violation of parameter constraints are avoided through the modification and result in stable line frequency spectrum for the generated speech.

17 Claims, 9 Drawing Sheets

OTHER PUBLICATIONS

Zen, et al., "The HMM-Based Speech Synthesis System (HTS) Version 2.0", Retrieved at <<http://www.cs.cmu.edu/~awb/papers/ssw6/ssw6_294.pdf>>, 6th ISCA Workshop on Speech Synthesis, Aug. 22-24, 2007, pp. 294-199.

Coelho, et al ., "Voice Pleasantness: on the Improvement of TTS Voice Quality", Retrieved at <<http://download.microsoft.com/download/A/0/B/A0B1A66A-5EBF-4CF3-9453-4B13BB027F1F/jth08voicequality.pdf>>, V Jornadas en Tecnologia del Habla, Nov. 12-14, 2008, pp. 6.

* cited by examiner

HIDDEN MARKOV MODEL BASED TEXT TO SPEECH SYSTEMS EMPLOYING ROPE-JUMPING ALGORITHM

BACKGROUND

Speech is the natural form of human communication, and it can enhance human machine communication. A text-to-speech system (TTS) is one of the human-machine interfaces using speech. TTSs, which can be implemented in software or hardware, convert normal language text into speech. TTSs are implemented in many applications such as car navigation systems, information retrieval over the telephone, voice mail, speech-to-speech translation systems, and comparable ones with a goal of synthesizing speech with natural human voice characteristics.

Synthesized speech can be created by concatenating pieces of recorded speech from a data store or generated by a synthesizer that incorporates a model of the vocal tract and other human voice characteristics to create a completely synthetic voice output. Hidden Markov Model (HMM) based synthesis is a synthesis method based on hidden Markov models. A frequency spectrum (vocal tract), a fundamental frequency (vocal source), and a duration (prosody) of speech are modeled simultaneously by HMMs. Speech waveforms are then generated from HMMs themselves based on the maximum likelihood criterion.

The increasingly popular HMM based text to speech systems (HTSs) generate a series of acoustic parameters and synthesize waves based on these parameters such as Line Frequency Spectrum (LFS). The acoustic parameters typically include constraints, but those constraints may be violated during the generation of the parameters from HMMs, which results in artifacts in the generated speech such as noise.

SUMMARY

This summary is provided to introduce a selection of concepts in a simplified form that are further described below in the Detailed Description. This summary is not intended to exclusively identify key features or essential features of the claimed subject matter, nor is it intended as an aid in determining the scope of the claimed subject matter.

Embodiments are directed to employing a rope-jumping algorithm to determine start and end models in a Hidden Markov Model based text to speech system and modify the start and end models by setting small co-variances. Through the modified start and end models disordered acoustic parameters and resulting unstable line frequency spectrum are avoided.

These and other features and advantages will be apparent from a reading of the following detailed description and a review of the associated drawings. It is to be understood that both the foregoing general description and the following detailed description are explanatory and do not restrict aspects as claimed.

DETAILED DESCRIPTION

As briefly described above, distortion in speech synthesized by an HTS may be reduced by modifying start and end models of LFS through setting a small co-variance for those models. In the following detailed description, references are made to the accompanying drawings that form a part hereof, and in which are shown by way of illustrations specific embodiments or examples. These aspects may be combined, other aspects may be utilized, and structural changes may be made without departing from the spirit or scope of the present disclosure. The following detailed description is therefore not to be taken in a limiting sense, and the scope of the present invention is defined by the appended claims and their equivalents.

While the embodiments will be described in the general context of program modules that execute in conjunction with an application program that runs on an operating system on a personal computer, those skilled in the art will recognize that aspects may also be implemented in combination with other program modules.

Generally, program modules include routines, programs, components, data structures, and other types of structures that perform particular tasks or implement particular abstract data types. Moreover, those skilled in the art will appreciate that embodiments may be practiced with other computer system configurations, including hand-held devices, multiprocessor systems, microprocessor-based or programmable consumer electronics, minicomputers, mainframe computers, and comparable computing devices. Embodiments may also be practiced in distributed computing environments where tasks are performed by remote processing devices that are linked through a communications network. In a distributed computing environment, program modules may be located in both local and remote memory storage devices.

Embodiments may be implemented as a computer-implemented process (method), a computing system, or as an article of manufacture, such as a computer program product or computer readable media. The computer program product may be a computer storage medium readable by a computer system and encoding a computer program that comprises instructions for causing a computer or computing system to perform example process(es). The computer-readable storage medium can for example be implemented via one or more of a volatile computer memory, a non-volatile memory, a hard drive, a flash drive, a floppy disk, or a compact disk, and comparable media.

Throughout this specification, the term "server" generally refers to a computing device executing one or more software programs typically in a networked environment. However, a server may also be implemented as a virtual server (software programs) executed on one or more computing devices viewed as a server on the network. More detail on these technologies and example operations is provided below. The term "client" refers to client devices and/or applications.

Figure 1:
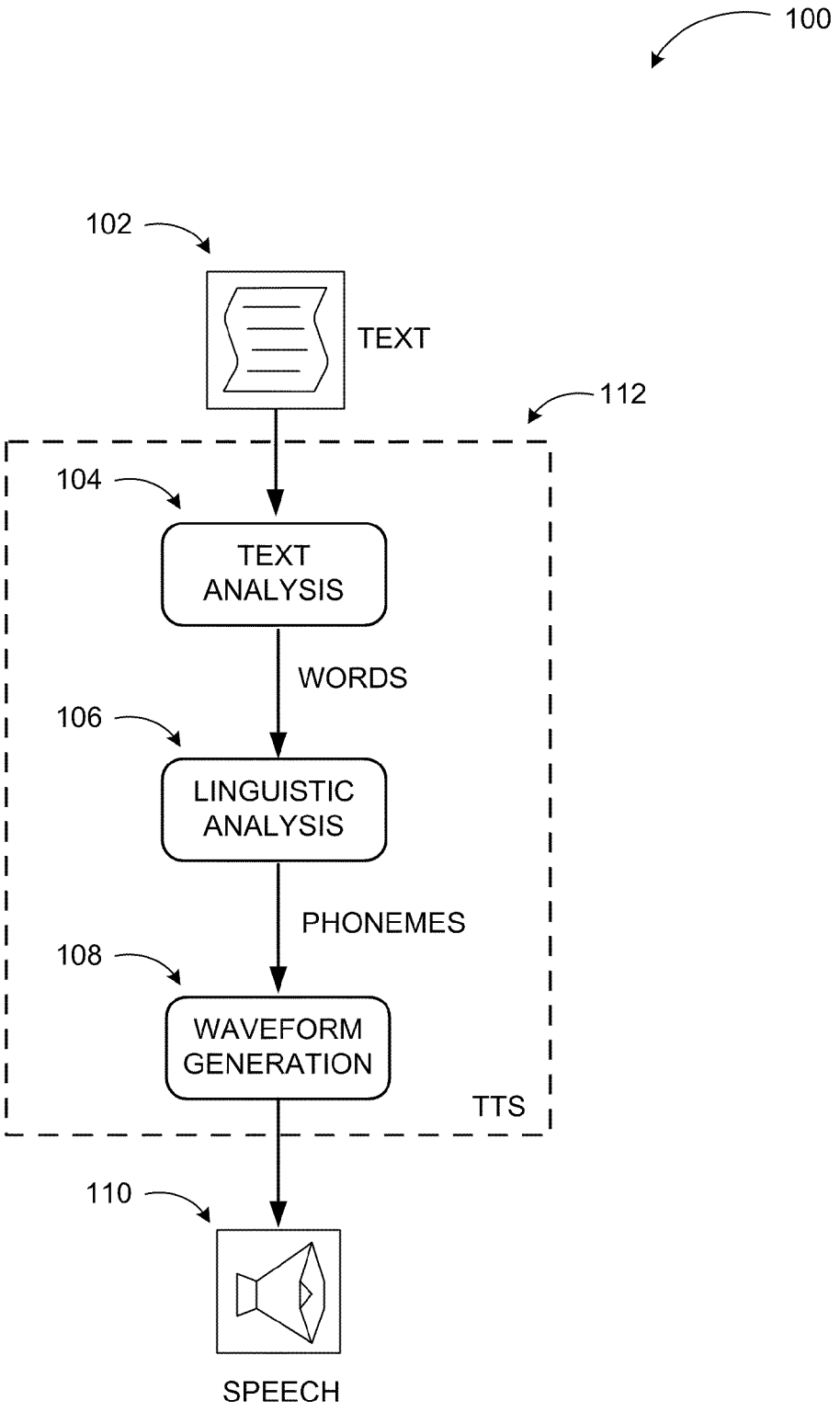
FIG. 1 is a block diagram illustrating top level components in a text to speech system.

Referring to FIG. 1, block diagram 100 of top level components in a text to speech system is illustrated. Synthesized speech can be created by concatenating pieces of recorded speech from a data store or generated by a synthesizer that incorporates a model of the vocal tract and other human voice characteristics to create a completely synthetic voice output.

Text to speech system (TTS) 112 converts text 102 to speech 110 by performing an analysis on the text to be converted, an optional linguistic analysis, and a synthesis putting together the elements of the final product speech. The text to be converted may be analyzed by text analysis component 104 resulting in individual words, which are analyzed by the linguistic analysis component 106 resulting in phonemes. Waveform generation component 108 synthesizes output speech 110 based on the phonemes.

Depending on a type of TTS, the system may include additional components. The components may perform additional or fewer tasks and some of the tasks may be distributed among the components differently. For example, text normalization, pre-processing, or tokenization may be performed on the text as part of the analysis. Phonetic transcriptions are then assigned to each word, and the text divided and marked into prosodic units, like phrases, clauses, and sentences. This text-to-phoneme or grapheme-to-phoneme conversion is performed by the linguistic analysis component 106.

Two major types of generating synthetic speech waveforms are concatenative synthesis and formant synthesis. Concatenative synthesis is based on the concatenation (or stringing together) of segments of recorded speech. While producing close to natural-sounding synthesized speech, in this form of speech generation differences between natural variations in speech and the nature of the automated techniques for segmenting the waveforms may sometimes result in audible glitches in the output. Sub-types of concatenative synthesis include unit selection synthesis, which uses large databases of recorded speech. During database creation, each recorded utterance is segmented into some or all of individual phones, diphones, half-phones, syllables, morphemes, words, phrases, and sentences. An index of the units in the speech database is then created based on the segmentation and acoustic parameters like the fundamental frequency (pitch), duration, position in the syllable, and neighboring phones. At runtime, the desired target utterance is created by determining the best chain of candidate units from the database (unit selection).

Another sub-type of concatenative synthesis is diphone synthesis, which uses a minimal speech database containing all the diphones (sound-to-sound transitions) occurring in a language. A number of diphones depends on the phonotactics of the language. At runtime, the target prosody of a sentence is superimposed on these minimal units by means of digital signal processing techniques such as linear predictive coding. Yet another sub-type of concatenative synthesis is domain-specific synthesis, which concatenates prerecorded words and phrases to create complete utterances. This type is more compatible for applications where the variety of texts to be outputted by the system is limited to a particular domain.

In contrast to concatenative synthesis, formant synthesis does not use human speech samples at runtime. Instead, the synthesized speech output is created using an acoustic model. Parameters such as fundamental frequency, voicing, and noise levels are varied over time to create a waveform of artificial speech. While the speech generated by formant synthesis may not be as natural as one created by concatenative synthesis, formant-synthesized speech can be reliably intelligible, even at very high speeds, avoiding the acoustic glitches that are commonly found in concatenative systems. High-speed synthesized speech is, for example, used by the visually impaired to quickly navigate computers using a screen reader. Formant synthesizers can be implemented as smaller software programs and can, therefore, be used in embedded systems, where memory and microprocessor power are especially limited.

HMM-based speech synthesis is also an acoustic model based synthesis method employing Hidden Markov Models. Frequency spectrum (vocal tract), fundamental frequency (vocal source), and duration (prosody) of speech are commonly modeled simultaneously by HMMs. Speech waveforms are then generated from HMMs themselves based on a maximum likelihood criterion.

Figure 2:
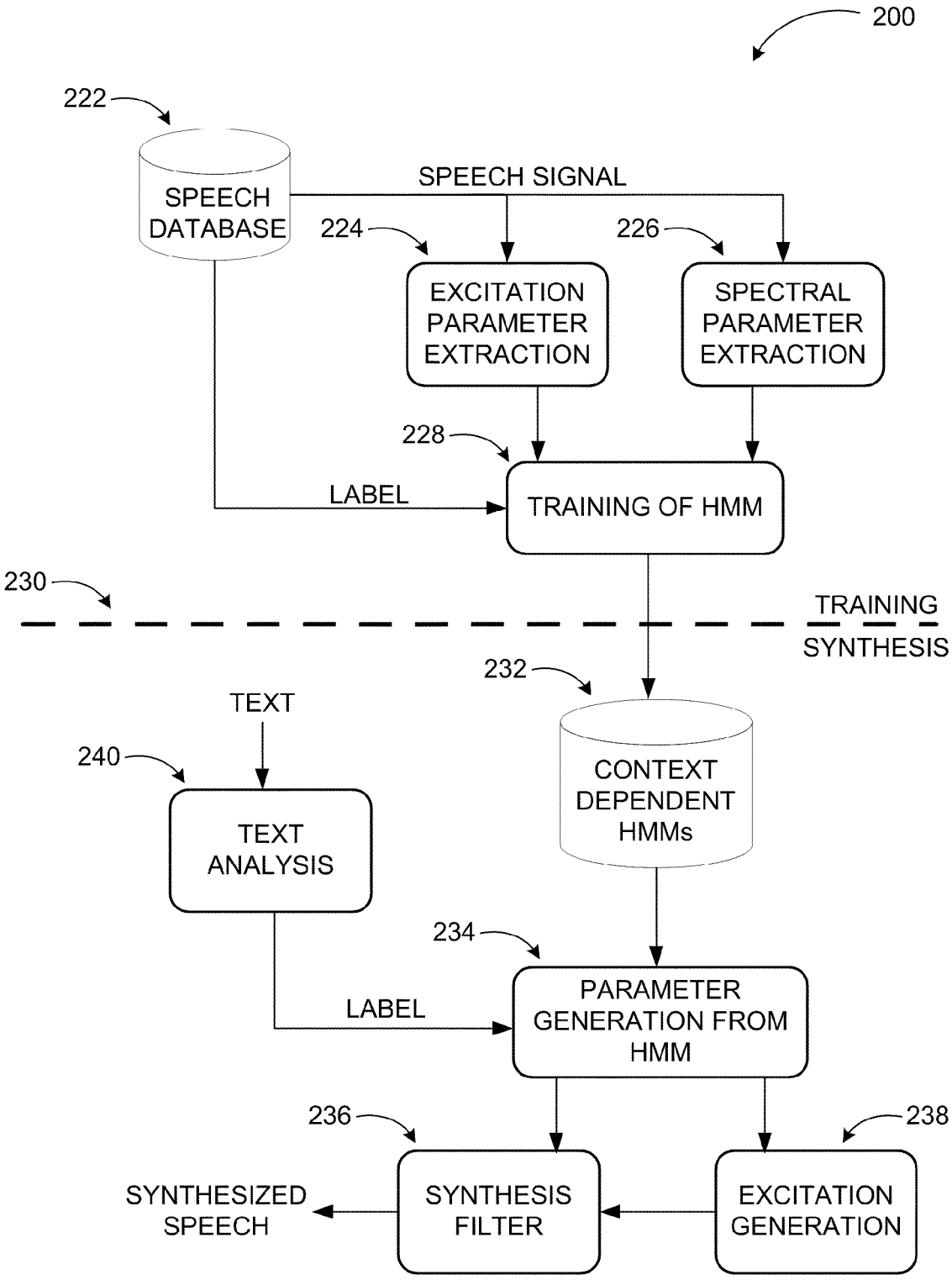
FIG. 2 is a block diagram illustrating an example HMM based text to speech system (HTS)

FIG. 2 is block diagram 200 illustrating an example HMM based text to speech system (HTS). An HMM is a statistical model in which the system being modeled is assumed to be a Markov process with unobserved state. An HMM can be considered as a simple dynamic Bayesian network.

In a regular Markov model, the state is directly visible to the observer, and therefore the state transition probabilities are the only parameters. In a Hidden Markov model, the state is not directly visible, but an output dependent on the state is visible. Each state has a probability distribution over the possible output tokens. Therefore, the sequence of tokens generated by an HMM gives some information about the sequence of states. Thus, 'Hidden' refers to the state sequence through which the model passes, not to the parameters of the model.

HMM based text to speech systems (HTSs), which can be automatically trained, can generate natural and high quality synthetic speech and reproduce voice characteristics of the original speaker. HTSs utilize the flexibility of HMMs such as context-dependent modeling, dynamic feature parameters, mixture of Gaussian densities, tying mechanism, speaker and environment adaptation techniques.

HMM-based approaches to speech synthesis begin with transcription and segmentation of speech database 222 (through excitation parameter extraction 224 and spectral parameter extraction 226) and train the HMM based system (228) during training phase. The synthesis process may be divided into two phases (230): training phase and the synthesis phase. The segmentation of the speech database also includes construction of an inventory of speech segments such that multiple instances of speech segments can be selected at runtime.

In the synthesis phase, context dependent HMMs 232 are used to generate excitation and spectral parameters (234) based on text analysis (240) results. Excitation is generated (238) based on the excitation parameters, and speech is synthesized by synthesis filter 236 based on the excitation and spectral parameters from the HMMs. Voice characteristics of synthetic speech can be changed by transforming HMM parameters appropriately.

Figure 3:
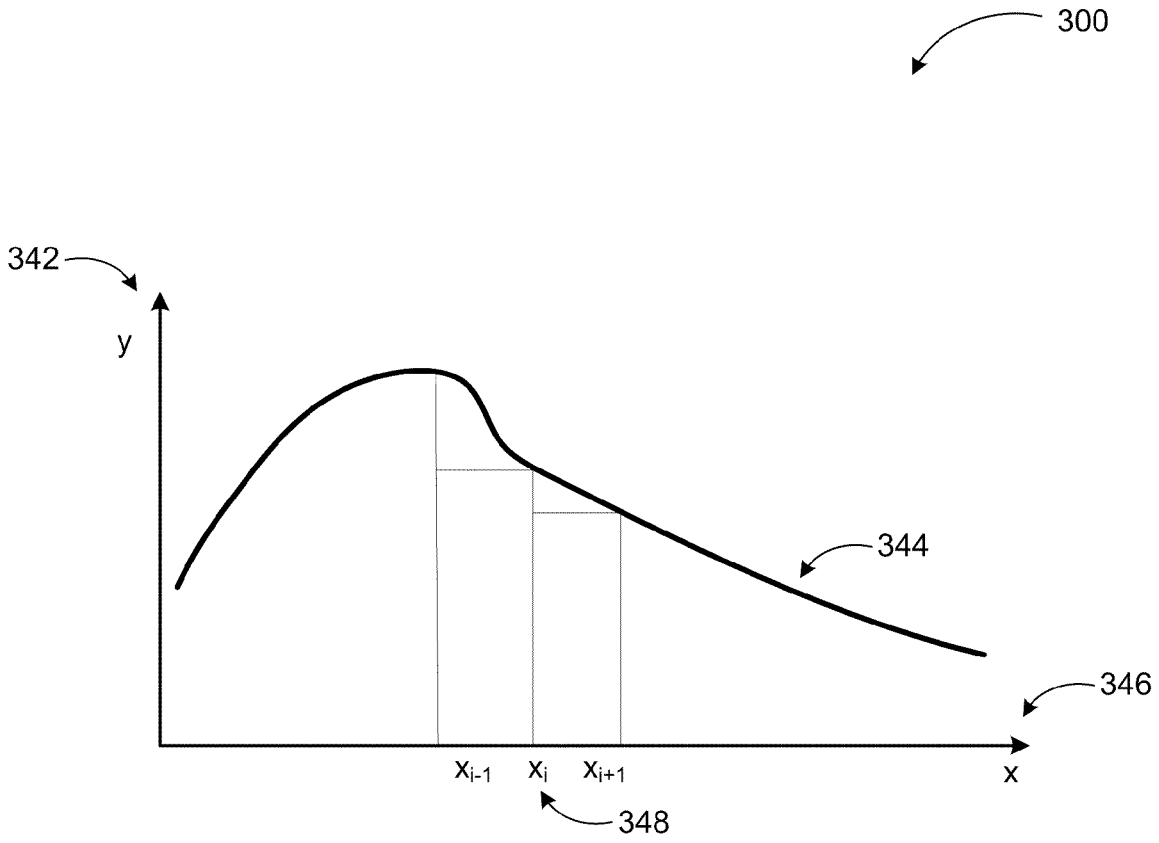
FIG. 3 illustrates delta and acceleration coefficients in a waveform synthesizing text to speech system.

FIG. 3 illustrates delta and acceleration coefficients in a waveform synthesizing text to speech system in diagram 300. In HTS, the acoustic parameters are generated from HMMs, which use a distribution or a set of distributions to model the data. For example, normal distribution may be used to model acoustic parameters as shown in the diagram with x-axis 346 and y-axis 342. The parameter curve (e.g. Line Frequency Spectrum parameter) follows the normal distribution.

To obtain a more expressive text to speech result, a delta coefficient and an acceleration coefficient may be defined within the HTS. HMMs are then used to model the two coefficients via normal distribution. The coefficients are defined as (for x-value 348):

$$\text{Delta: } \Delta = \frac{(x_{i+1} - x_i) + (x_i - x_{i-1})}{2} = \frac{x_{i+1} - x_{i-1}}{2}, \text{ and} \quad [1]$$

[1] Delta:

$$\text{Acceleration: } \Delta^2 = (x_{i+1} - x_i) - (x_i - x_{i-1}) = x_{i+1} - 2x_i + x_{i-1}. \quad [2]$$

If the original value is considered as a special case of the coefficients, the window coefficients matrix may be written as:

$$W = \begin{pmatrix} 0 & 1 & 0 \\ 1/2 & 0 & 1/2 \\ 1 & -2 & 1 \end{pmatrix}, \text{ and} \quad [3]$$

the process for generating the acoustic parameters may be summarized by the formula:

$$W^T U^{-1} M = W^T U^{-1} W C, \quad [4b]$$

where W is the window coefficients matrix, U is the covariance diagonal matrix of the three HMMs (original value, delta coefficient, and acceleration coefficient), M is the mean vector of the three HMMs, and C is the vector of desired acoustic parameters. The window referred to herein is the window of parameterized acoustic waveform.

Figure 4:
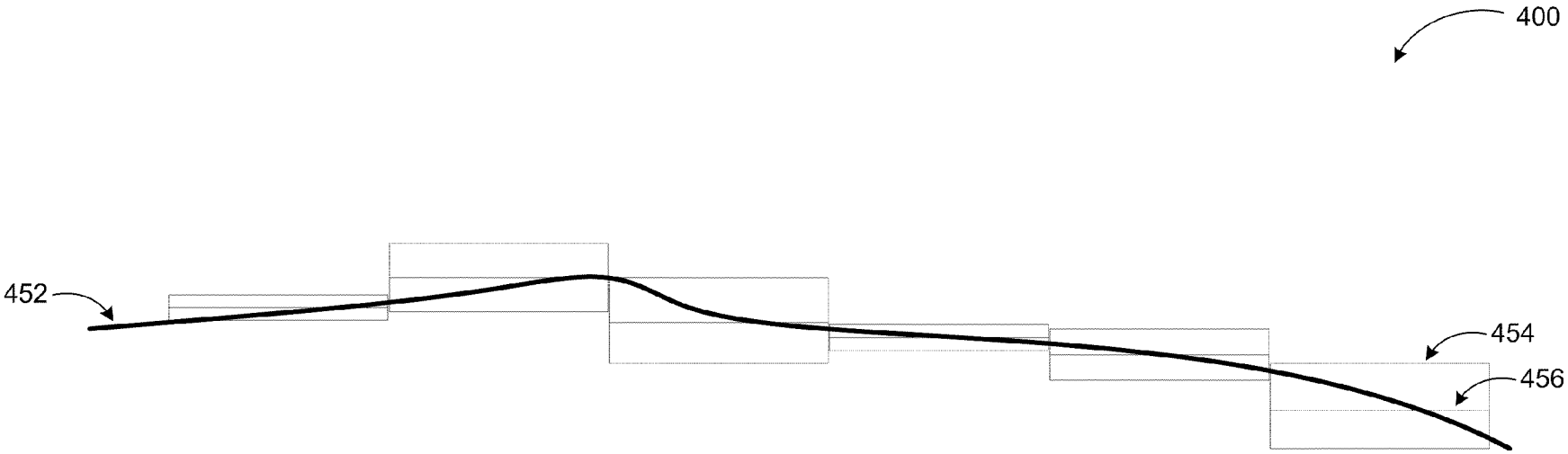
FIG. 4 illustrates a Line Frequency Spectrum (LFS) function and associated models.

FIG. 4 illustrates a Line Frequency Spectrum (LFS) function and associated models in diagram 400. LFS parameters (for LSF pairs or LSP) are used to synthesize speech by enabling the synthesizer generate different voices through multiple sets of stored segments. Since the LFS is in frequency domain, a change in one parameter affects the spectrum only in that particular frequency region allowing fine adjustments to be made easily to the synthesized speech. The LFS curve 452 shown in diagram 400 is divided into acoustic parameters and a variance and a mean of each parameter is shown by a rectangle (e.g. rectangle 456) around the parameterized LFS segment and a line crossing the variance rectangle (e.g. line 454).

The overall LFS can be smoothed or otherwise modified by modifying the parameters (or their variances). However, by definition, the delta and acceleration coefficients do not exist at the beginning and end of the waveform. Thus, there are very weak constraints with the generated parameters at the beginning and end. During the process parameterizing the LFS, the parameters are computed iteratively from the beginning to the end (or vice versa), which means the beginning (or end) parameters may have almost random values since they have weak constraints. If the curves of an LFS pair intersect due to parameterization problems, unacceptable noise or distortion may result in the synthesized speech. LFS pair parameters are naturally ordered and continuous even across unvoiced sounds. However, the beginning and end values as discussed above may result in disordered parameters and thereby distortion in the end product.

Figure 5:
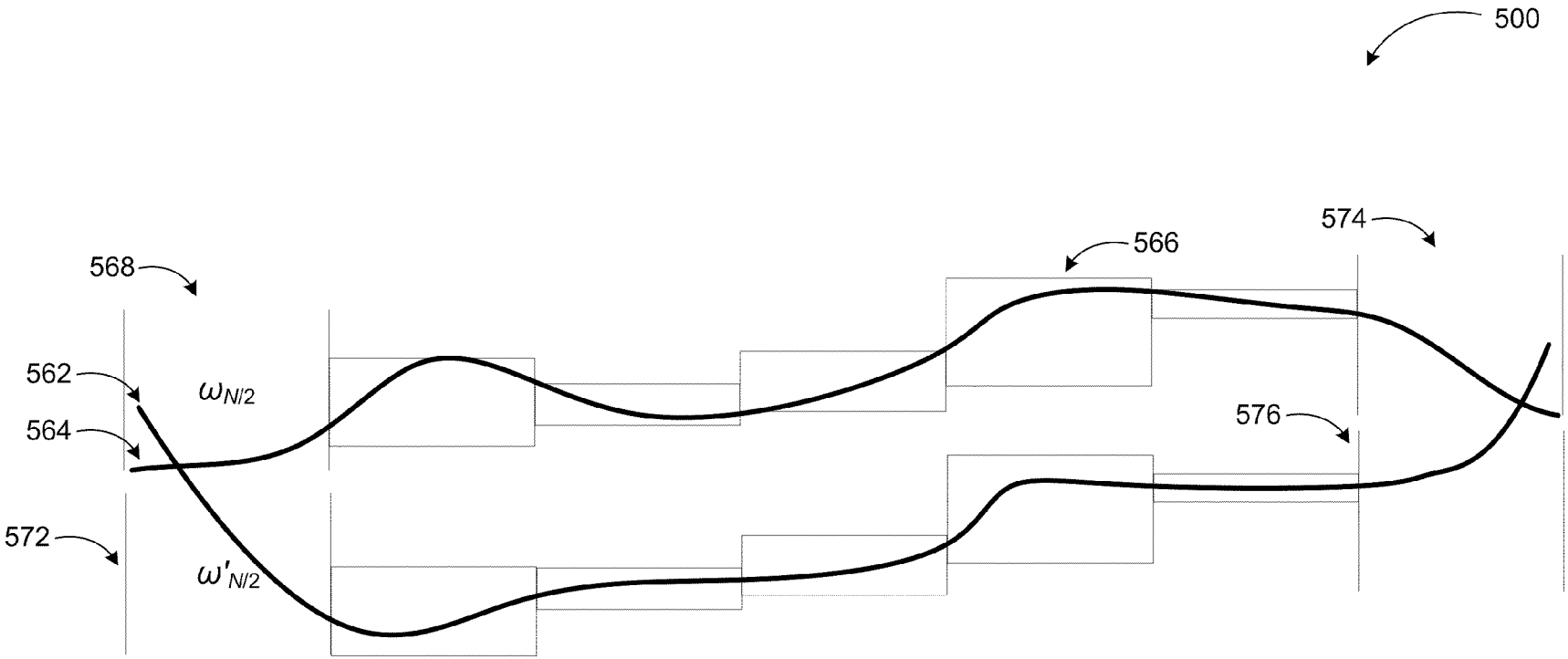
FIG. 5 illustrates how violation of constraints in start and end models of the LFS can result in disordered parameters and ultimately distortion of the generated waveform.

FIG. 5 illustrates how violation of constraints in start and end models of the LFS can result in disordered parameters and ultimately distortion of the generated waveform. Diagram 500 displays the curves (and models) of an LFS pair (562 and 564). Through the iterative process, models (e.g. 566) of both curves can be smoothed by having strong constraints (variances). However, as discussed above, the constraints are weak or non-existing for the beginning and end models (568, 572, 574, and 576). This may result in intersection of the pair at the beginning and at the end causing unacceptable distortion (noise) in the synthesized speech.

Figure 6:
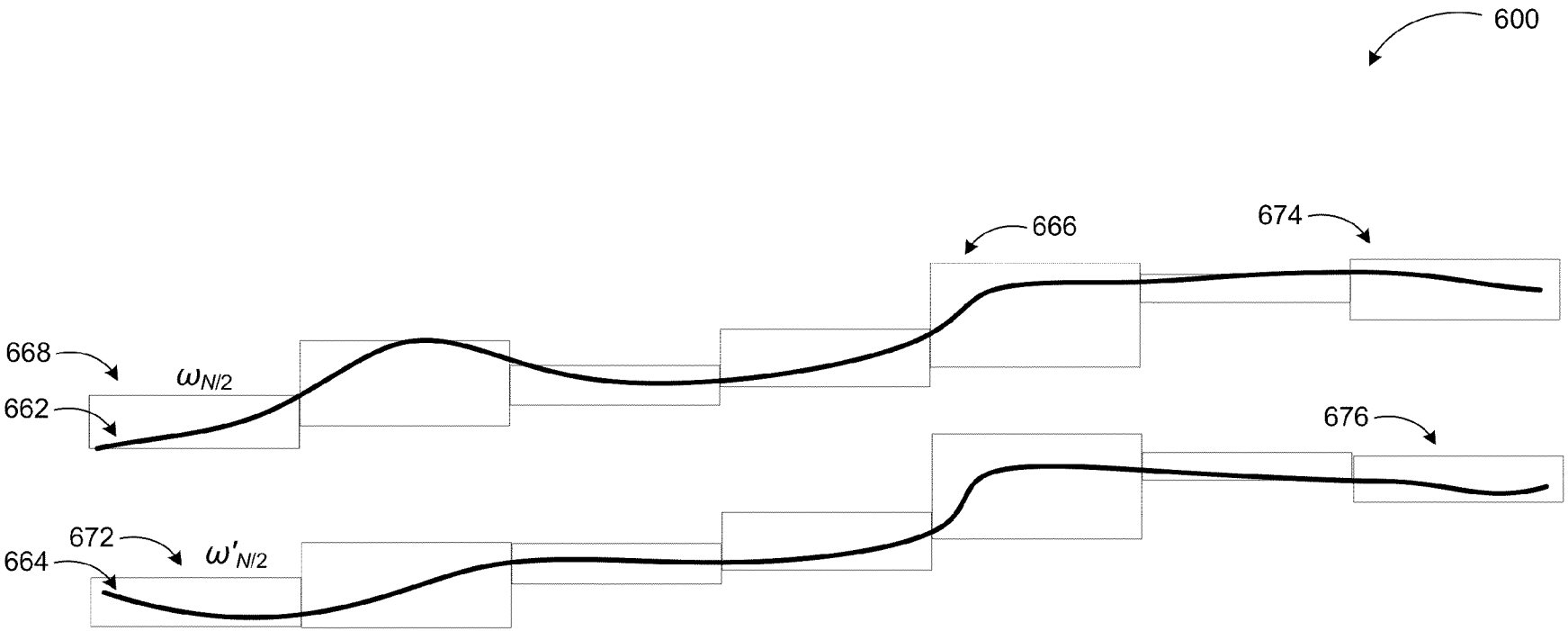
FIG. 6 illustrates modification of the start and end models of the LFS and prevention of the distortion in an HTS according to embodiments.

FIG. 6 illustrates modification of the start and end models of the LFS and prevention of the distortion in an HTS according to embodiments. The weak constraint related instability of the beginning and end models of the LFS are addressed through a rope-jumping algorithm in an HTS according to embodiments. The term rope-jumping algorithm is derived from the similarity of the LFS pair curves to ropes in rope-jumping games. As in the namesake game, the ropes should not intersect. To achieve a stable LFS pair (662, 664) as shown in diagram 600, upon selection of the models in the LFS pair, the beginning and end models (668, 672, 674, and 676) are modified by setting small co-variances for those parameters.

Since the small co-variances provide strong constraints on the beginning and end parameters, respective pairs do no longer intersect and the distortion in the synthesized speech due to parameterization is avoided. The relatively small co-variances force the parameters to converge to their mean value (hence the similarity to rope-jumping game). While a range of values may be selected for the beginning and end co-variances depending on system parameters such as overall change in the LFS, desired speech quality, language, voice characteristics, and the like, a value of 0.01 has been found to satisfy most languages experimentally. The co-variance value may also be modified dynamically depending on the language, for example in the range of 0.01 to 0.05. These values are exemplary only and do not constitute a limitation on embodiments. As mentioned above, the co-variance values may be selected from a range based on system requirements, user preferences, and so on.

While the example systems and processes have been described with specific components and aspects such as particular synthesis system components and LFS, embodiments are not limited to the example components and configurations. An HTS employing a rope-jumping algorithm to smooth beginning and end models may be implemented in other systems and configurations using other aspects of speech synthesis using the principles described herein.

Figure 7:
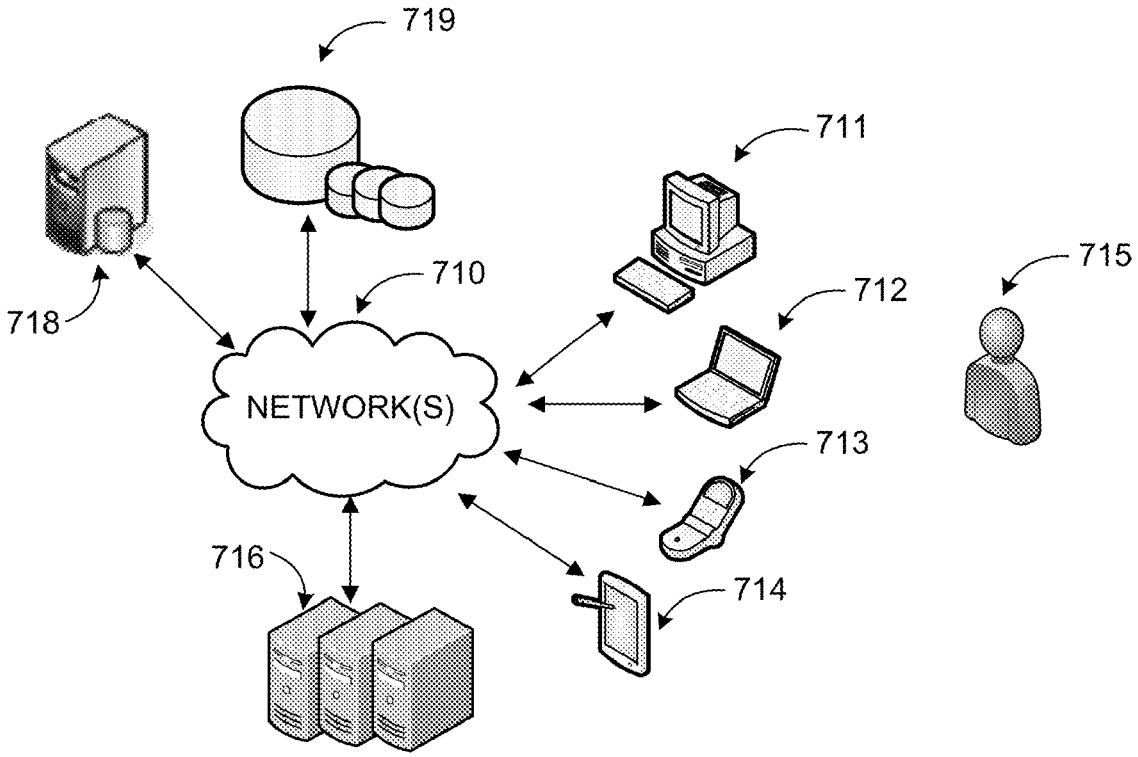
FIG. 7 is a networked environment, where a system according to embodiments may be implemented.

FIG. 7 is an example networked environment, where embodiments may be implemented. A Hidden Markov Model based text to speech system providing speech synthesis services may be implemented via software executed in individual client devices 711 through 714 or over one or more servers 716 such as a hosted service. The system may facilitate communications between client applications on individual computing devices (client devices 711-714) for user 715 through network(s) 710.

Client devices 711-714 may provide synthesized speech to user 715. Speech synthesis may be performed by generating acoustic parameters from a text analysis after the HMM based system is trained based on input from a speech database. Distortion in the synthesized speech may be reduced by determining start and end models of LFS and setting small co-variances for those models to prevent disordered parameters. Information associated with speech synthesis may be stored in one or more data stores (e.g. data stores 719), which may be managed by any one of the servers 716 or by database server 718.

Network(s) 710 may comprise any topology of servers, clients, Internet service providers, and communication media. A system according to embodiments may have a static or dynamic topology. Network(s) 710 may include a secure network such as an enterprise network, an unsecure network such as a wireless open network, or the Internet. Network(s) 710 may also coordinate communication over other networks such as PSTN or cellular networks. Network(s) 710 provides communication between the nodes described herein. By way of example, and not limitation, network(s) 710 may include wireless media such as acoustic, RF, infrared and other wireless media.

Many other configurations of computing devices, applications, data sources, and data distribution systems may be employed to implement an HTS employing a rope-jumping algorithm to prevent distortion due to disordered parameters. Furthermore, the networked environments discussed in FIG. 7 are for illustration purposes only. Embodiments are not limited to the example applications, modules, or processes.

Figure 8:
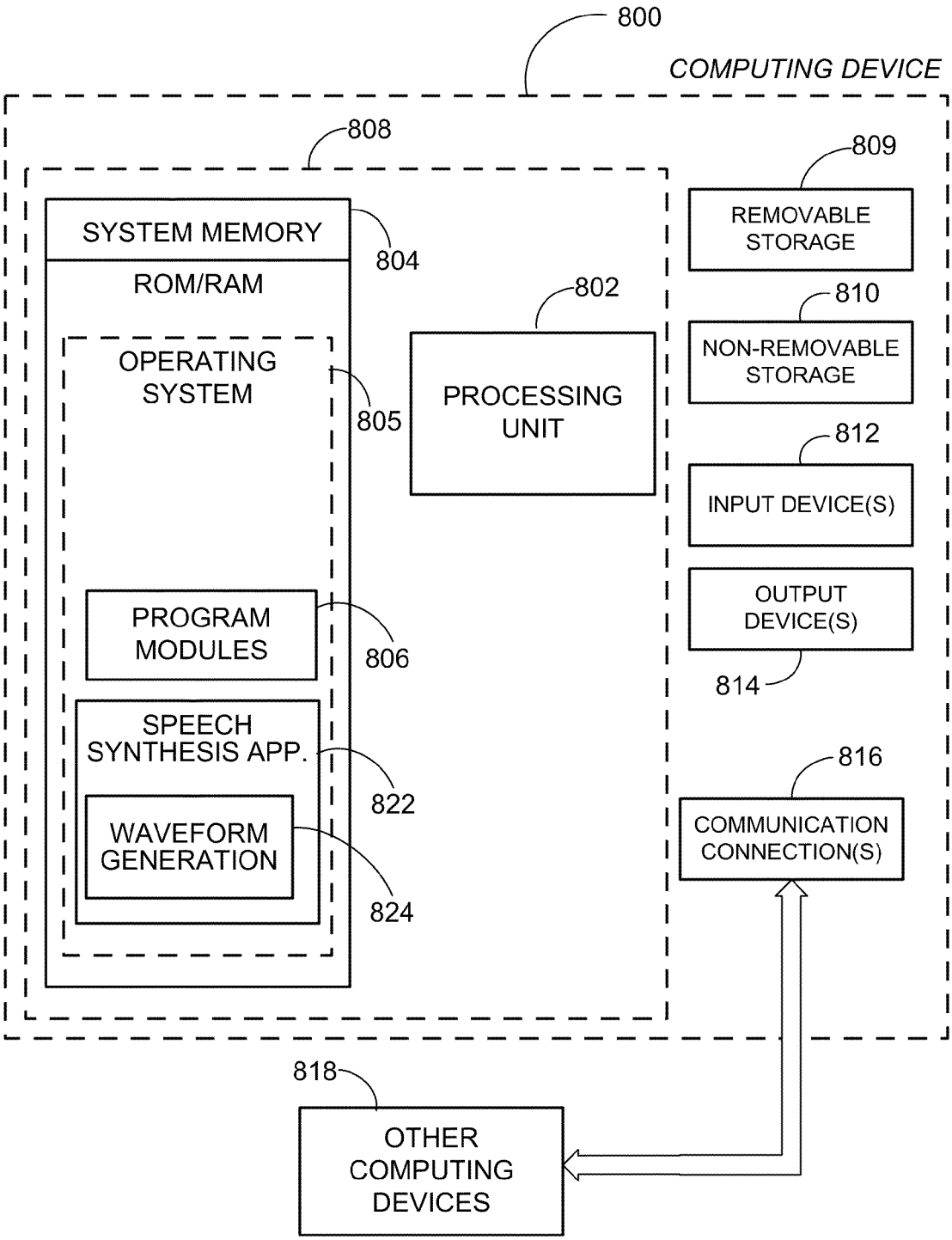
FIG. 8 is a block diagram of an example computing operating environment, where embodiments may be implemented.

FIG. 8 and the associated discussion are intended to provide a brief, general description of a suitable computing environment in which embodiments may be implemented. With reference to FIG. 8, a block diagram of an example computing operating environment for an application according to embodiments is illustrated, such as computing device 800. In a basic configuration, computing device 800 may be a client device executing an HTS and include at least one processing unit 802 and system memory 804. Computing device 800 may also include a plurality of processing units that cooperate in executing programs. Depending on the exact configuration and type of computing device, the system memory 804 may be volatile (such as RAM), non-volatile (such as ROM, flash memory, etc.) or some combination of the two. System memory 804 typically includes an operating system 805 suitable for controlling the operation of the platform, such as the WINDOWS® operating systems from MICROSOFT CORPORATION of Redmond, Wash. The system memory 804 may also include one or more software applications such as program modules 806, speech synthesis application 822, and waveform generation module 824.

Speech synthesis application 822 may be part of a service or the operating system 805 of the computing device 800. Speech synthesis application 822 generates synthesized speech employing HMMs. As discussed previously, generated speech may include distortion due to violation of parameter constraints during the generation of HMMs. Waveform generation module 824 or speech synthesis application 822 itself may employ a rope-jumping algorithm to determine start and end models in LSF and smooth the curve by setting small co-variances for the start and end models. This basic configuration is illustrated in FIG. 8 by those components within dashed line 808.

Computing device 800 may have additional features or functionality. For example, the computing device 800 may also include additional data storage devices (removable and/or non-removable) such as, for example, magnetic disks, optical disks, or tape. Such additional storage is illustrated in FIG. 8 by removable storage 809 and non-removable storage 810. Computer readable storage media may include volatile and nonvolatile, removable and non-removable media implemented in any method or technology for storage of information, such as computer readable instructions, data structures, program modules, or other data. System memory 804, removable storage 809 and non-removable storage 810 are all examples of computer readable storage media. Computer readable storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer readable storage media may be part of computing device 800. Computing device 800 may also have input device(s) 812 such as keyboard, mouse, pen, voice input device, touch input device, and comparable input devices. Output device(s) 814 such as a display, speakers, printer, and other types of output devices may also be included. These devices are well known in the art and need not be discussed at length here.

Computing device 800 may also contain communication connections 816 that allow the device to communicate with other devices 818, such as over a wireless network in a distributed computing environment, a satellite link, a cellular link, and comparable mechanisms. Other devices 818 may include computer device(s) that execute communication applications, other servers, and comparable devices. Communication connection(s) 816 is one example of communication media. Communication media can include therein computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

Example embodiments also include methods. These methods can be implemented in any number of ways, including the structures described in this document. One such way is by machine operations, of devices of the type described in this document.

Another optional way is for one or more of the individual operations of the methods to be performed in conjunction with one or more human operators performing some. These human operators need not be collocated with each other, but each can be only with a machine that performs a portion of the program.

Figure 9:
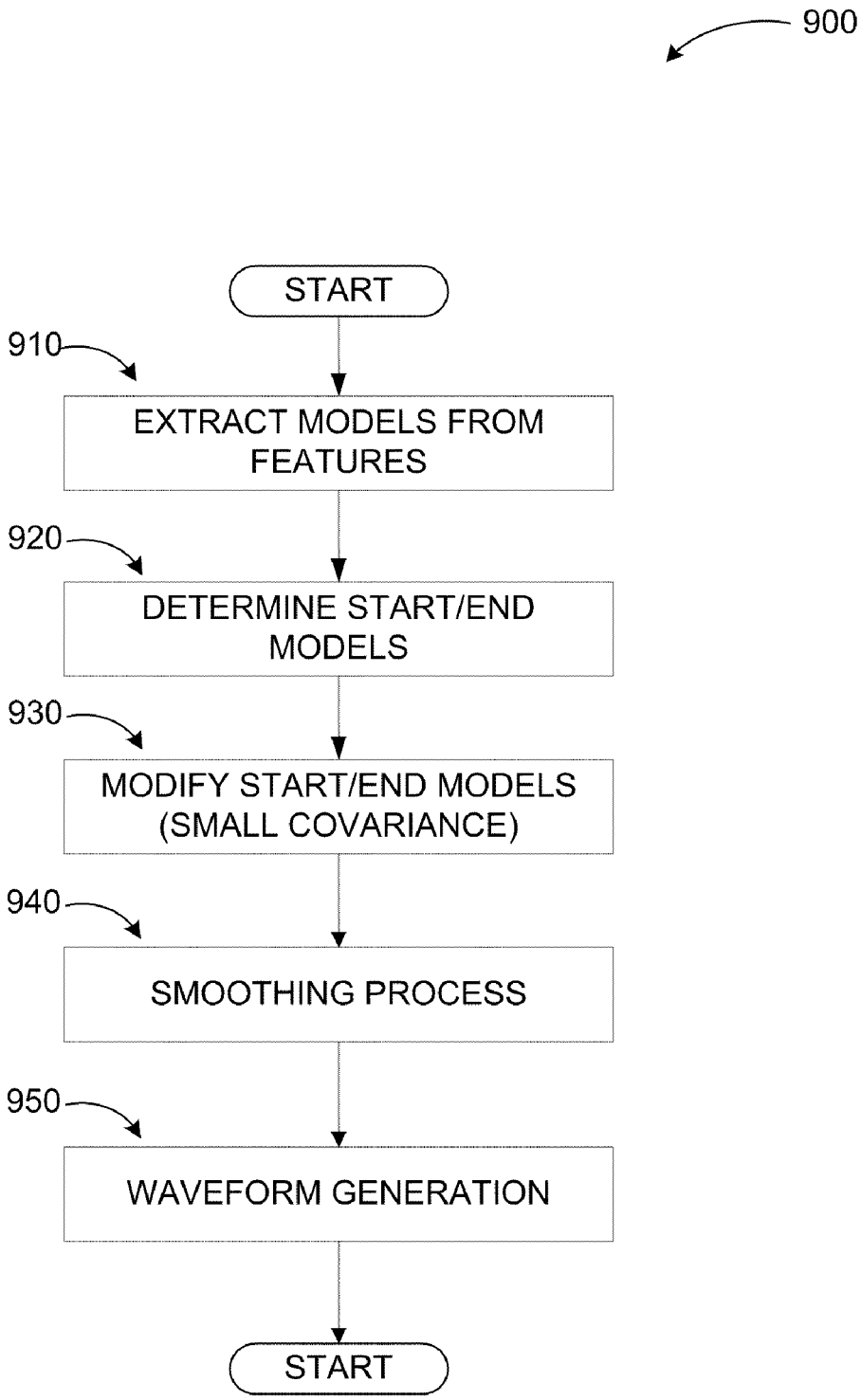
FIG. 9 illustrates a logic flow diagram for preventing distortion of synthesized waveform in an HTS by modifying start and end models according to embodiments.

FIG. 9 illustrates a logic flow diagram for process 900 of preventing distortion of synthesized waveform in an HTS by modifying start and end models according to embodiments. Process 900 may be implemented as part of a speech generation program in any computing device. For example, input text may be analyzed by a text analysis engine and synthesis operations may be performed by a speech synthesis engine.

Process 900 begins with operation 910, where Hidden Markov Models are extracted from features derived as a result of the analysis of the text to be converted to speech. At operation 920, the start and end models for the LSF are determined. Since the start and end models do not include delta or acceleration by definition, these models include weak constraints. Thus, at the beginning and end points LSFs may intersect resulting in distortion and/or noise in the generated speech.

To reduce the disorder of the parameters and the resulting distortion, the start and end models are modified at operation 930 by setting small co-variances for those as discussed previously. The co-variances for the start and end models may be the same or distinctly determined. Process 900 continues with the smoothing process at operation 940 and waveform generation (synthesized speech) without the noise caused by the disordered parameters of LSF at subsequent operation 950. The co-variance value for the start and the end segments may be determined based on a language of the generated speech, a shape of the overall LFS waveform, a desired speech quality, and/or a characteristic of a source vocal tract.

The operations included in process 900 are for illustration purposes. An HTS employing a rope-jumping algorithm to smooth LSF and, thereby, reduce distortion in generated speech may be implemented by similar processes with fewer or additional steps, as well as in different order of operations using the principles described herein.

The above specification, examples and data provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A method to be executed in a computing device for performing speech synthesis, the method comprising:

determining features as a result of analyzing text to be converted to speech;

determining acoustic models from a Line Frequency Spectrum (LFS) waveform from the features, the acoustic model employing a Hidden Markov Model (HMM) algorithm and including a variance and a mean value for each segment of the waveform, wherein the LFS waveform is used to synthesize speech by enabling a synthesizer to generate different voices through multiple sets of stored segments, and wherein a start model and an end model are unstable;

modifying the start and the end models such that they are stabilized by setting respective predefined co-variances for the start and the end models such that a segment of the LFS waveform in each model is near its mean value;

smoothing the LFS waveform based on the setting of the predefined co-variances for generating the speech;

generating the speech based on the smoothed LFS waveform.

2. The method of claim 1, wherein the respective co-variances for the start and the end models are determined based on a language for the generated speech.

3. The method of claim 1, wherein the respective co-variances are less than 0.05.

4. The method of claim 1, wherein the respective co-variances have the same value for the start and the end models.

5. The method of claim 1, wherein the variance and the mean for each of the acoustic models is determined through an iterative computation except for the start and the end models.

6. A computer-readable memory device with instructions stored thereon for performing speech synthesis, the instructions comprising:

determining acoustic parameters based on analyzing text to be converted to speech employing a Hidden Markov Model (HMM) algorithm, wherein the parameters are associated with segments of a Line Frequency Spectrum (LFS) waveform;

determining a delta coefficient defining a mean for each segment and an acceleration coefficient defining a variance for each segment through an iterative computation except for a start and an end segment;

setting a co-variance value for the start and the end segments such that a value of the LFS waveform converges to a mean value for the start and the end segments;

smoothing the LFS waveform by adjusting the acoustic parameters; and generating the speech based on the smoothed LFS waveform.

7. The computer-readable memory device of claim 6, wherein the delta coefficient for two adjacent segments positioned from $x_{i-1}$ to $x_i$ and from $x_i$ to $x_{i+1}$ is defined as:

$$\frac{(x_{i+1}-x_i)+(x_i-x_{i-1})}{2}=\frac{x_{i+1}-x_{i-1}}{2}.$$

8. The computer-readable memory device of claim 6, wherein the acceleration coefficient for two adjacent segments positioned from $x_{i-1}$ to $x_i$ and from $x_i$ to $x_{i+1}$ is defined as $(x_{i+1}-x_i)-(x_i-x_{i-1})=x_{i+1}-2x_i+x_{i-1}$.

9. The computer-readable memory device of claim 6, wherein a window coefficient matrix, W, for two adjacent segments positioned from $x_{i-1}$ to $x_i$ and from $x_i$ to $x_{i+1}$ is defined as:

$$W=\begin{pmatrix} 0 & 1 & 0 \\ 1/2 & 0 & 1/2 \\ 1 & -2 & 1 \end{pmatrix},$$

and wherein the acoustic parameters are computed by:

$$W^TU^{-1}M=W^TU^{-1}W\,C,$$

where U is a co-variance diagonal matrix of original value, delta coefficient, and acceleration coefficient HMMs, M is a mean vector of the original value, delta coefficient, and acceleration coefficient HMMs, and C is a vector of the acoustic parameters.

10. The computer-readable memory device of claim 6, wherein the LFS waveform is derived from a vocal tract.

11. The computer-readable memory device of claim 6, wherein the co-variance value for the start and the end segments is determined based on at least one from a set of: a language of the generated speech, a shape of the overall LFS waveform, a desired speech quality, and a characteristic of a source vocal tract.

12. The computer-readable memory device of claim 6, wherein the co-variance value for the start and the end segments is determined such that the waveforms of an LFS pair do not intersect.

13. A Hidden Markov Model based text to speech (HTS) synthesis system for generating speech from text, the system a computing device comprising:

a speech data store;

a text analysis engine; and a speech synthesis engine configured to:

determine acoustic parameters based on text analysis results from the text analysis engine employing a Hidden Markov Model (HMM) algorithm, wherein the parameters are associated with segments of a Line Frequency Spectrum (LFS) waveform pair;

determine a delta coefficient defining a mean for each segment and an acceleration coefficient defining a variance for each segment through an iterative computation except for a start and an end segment, the iterative computation employing the formula:

$$W^TU^{-1}M=W^TU^{-1}W\,C,$$

where U is a co-variance diagonal matrix of original value, delta coefficient, and acceleration coefficient HMMs, M is a mean vector of the original value, delta coefficient, and acceleration coefficient HMMs, C is a vector of the acoustic parameters, and W is defined as:

$$W = \begin{pmatrix} 0 & 1 & 0 \\ 1/2 & 0 & 1/2 \\ 1 & -2 & 1 \end{pmatrix};$$

set a co-variance value for the start and the end segments such that a value of the LFS waveforms in each start and end segment converges to a mean value;

smooth the LFS waveforms by adjusting the acoustic parameters; and generate the speech based on the smoothed LFS waveforms.

14. The system of claim 13, wherein the HMM algorithm is further employed to determine a vocal source fundamental frequency and a prosody of the generated speech.

15. The system of claim 13, wherein the HMMs are generated according to a statistical distribution.

16. The system of claim 15, wherein the statistical distribution includes one of: a normal distribution and a Gaussian distribution.

17. The system of claim 13, wherein the speech synthesis engine is trained employing excitation parameters and spectral parameters extracted from the speech data store.

* * * * *